US005888086A

United States Patent [19]

Yaegashi et al.

[11] Patent Number: 5,888,086

[45] Date of Patent: Mar. 30, 1999

[54] ELECTRICAL CONNECTOR

[75] Inventors: Hirokatsu Yaegashi; Ryozo Koyama; Kenichi Yamaguchi, all of Tokyo, Japan

[73] Assignee: Hirose Electric Co., Ltd., Tokyo, Japan

[21] Appl. No.: 936,114

[22] Filed: Sep. 24, 1997

[30] Foreign Application Priority Data

Oct. 2, 1996 [JP] Japan ..... 261541

[51] Int. Cl.[6] ..... H01R 13/62

[52] U.S. Cl. ..... 439/326

[58] Field of Search ..... 439/325–329, 439/629, 630

[56] References Cited

U.S. PATENT DOCUMENTS 5,203,714 4/1993 Tuan ..... 439/326

5,413,497 5/1995 Lwee ..... 439/328

5,690,502 11/1997 Mochizuki ..... 439/326

*Primary Examiner*—Khiem Nguyen

*Attorney, Agent, or Firm*—Kanesaka & Takeuchi

[57] ABSTRACT

An electrical connector includes a housing (3) with a base (4) having a slot(5); a plurality of contact elements (103, 105) provided in the slot; a pair of fixed members (21) extending laterally from opposite ends of the base; a pair of movable members (23) extending from the fixed members and having L-shaped cross-section foot areas; and a pair of fixing members (9) attached to the fixed members and having a first controlling section (301) to control outward movement of the movable members and a second controlling section (303) to control inward movement of the movable members.

6 Claims, 8 Drawing Sheets

ELECTRICAL CONNECTOR

BACKGROUND OF THE INVENTION

1. Field of the Invention

The present invention relates to electrical connectors to which daughter boards are connected by rotating the daughter boards to a lock position parallel to the mother boards.

2. Description of the Related Art

There is a demand for electrical connectors which occupy small areas on mother boards and provide large areas on daughter boards to mount many IC components, etc. Also, there is a demand for a low-profile electrical connectors for miniaturization of equipment.

Electrical connectors to which daughter boards are inserted obliquely and rotated downwardly to a lock position parallel to mother boards have been used to minimize the areas occupied by the electrical connectors. The electrical connectors are secured to the mother boards by the surface mounting technique.

An electrical connector of this type has a base with a slot into which a daughter board is inserted, and a pair of lock mechanisms to lock opposite side edges of the daughter board. A plurality of contact elements are provided in the slot for contact with the pads of the daughter board. The lock mechanisms have a movable section with a hook portion and a fixed section to protect the movable section and hold the daughter board.

One of the ways that the area of the mother board occupied by the electrical connector is minimized is to minimize the area of the lock mechanisms. In order to achieve this object, the lock mechanisms have been made from metal because it withstands large stress with small footage area. However, it is difficult to integrate the metal lock mechanisms with the plastic base. In addition, the lack of accurate assembling gives rise to unstable contact between the electrical connector and the daughter board.

In another conventional model, a metal armor is added to the movable section. However, the armor added to the movable section increases the area of a mother board occupied by the movable section, reducing the mounting area.

In order to increase the area of a daughter board on which IC components, etc. are mounted, it is desirable to minimize the area occupied by the lock mechanism on the daughter board. One of the conventional lock mechanisms is molded integrally with the connector body of an electrical connector, but the fixed section is provided outside the movable section which holds the daughter board so that the lock mechanism occupies a large area on the daughter board.

In order to provide a low-profile electrical connector, it is necessary to reduce the height of contact elements. To meet the requirement, it is necessary to reduce the height of contact elements while keeping the resilience of the contact elements.

One of the types of contact element is the so-called "stamped terminal." The stamped terminal is made by only stamping a metal sheet. The stamped terminal has a fixing section exposed to the mother board so that no or few circuit patterns are provided on the exposed area. In addition, the exposed area is soldered to the mother board, the terminal is so rigid that the insertion and removal force of a daughter board is very high while the amount of movement of the terminal is small. Moreover, the tolerance in thickness of daughter boards is too small to make daughter boards.

In order to receive a daughter board, the lock mechanisms must be flexible and, especially, the movable section must be resilient to withstand the opening movement. The conventional lock mechanisms are frequently broken by excessive movement and, therefore, there is a demand for a more reliable lock mechanism.

SUMMARY OF THE INVENTION

Accordingly, it is an object of the invention to provide an electrical connector having lock mechanisms which occupy small areas on the mother board and are stronger than before.

It is another object of the invention to provide an electrical connector having lock mechanisms occupying small areas on the daughter board.

It is still another object of the invention to provide a low-profile electrical connector having lower contact elements which are compact and resilient.

It is yet another object of the invention to provide an electrical connector having lock mechanisms of which the amount of change is controlled to prevent damage to the lock mechanisms.

According to the invention there is provided an electrical connector which includes a housing with a base having a slot; a plurality of contact elements provided in the slot; a pair of fixed members extending laterally from opposite ends of the base; a pair of movable members extending from the fixed members and having L-shaped cross-section foot areas; and a pair of fixing members attached to the fixed members and having a first controlling section to control outward movement of the movable members and a second controlling section to control inward movement of the movable members.

At least lower contact elements are of the bent terminals. The U-shaped sections of the bent terminals are folded back to provide a thicker resilient section

DESCRIPTION OF THE PREFERRED EMBODIMENT

Figure 1:
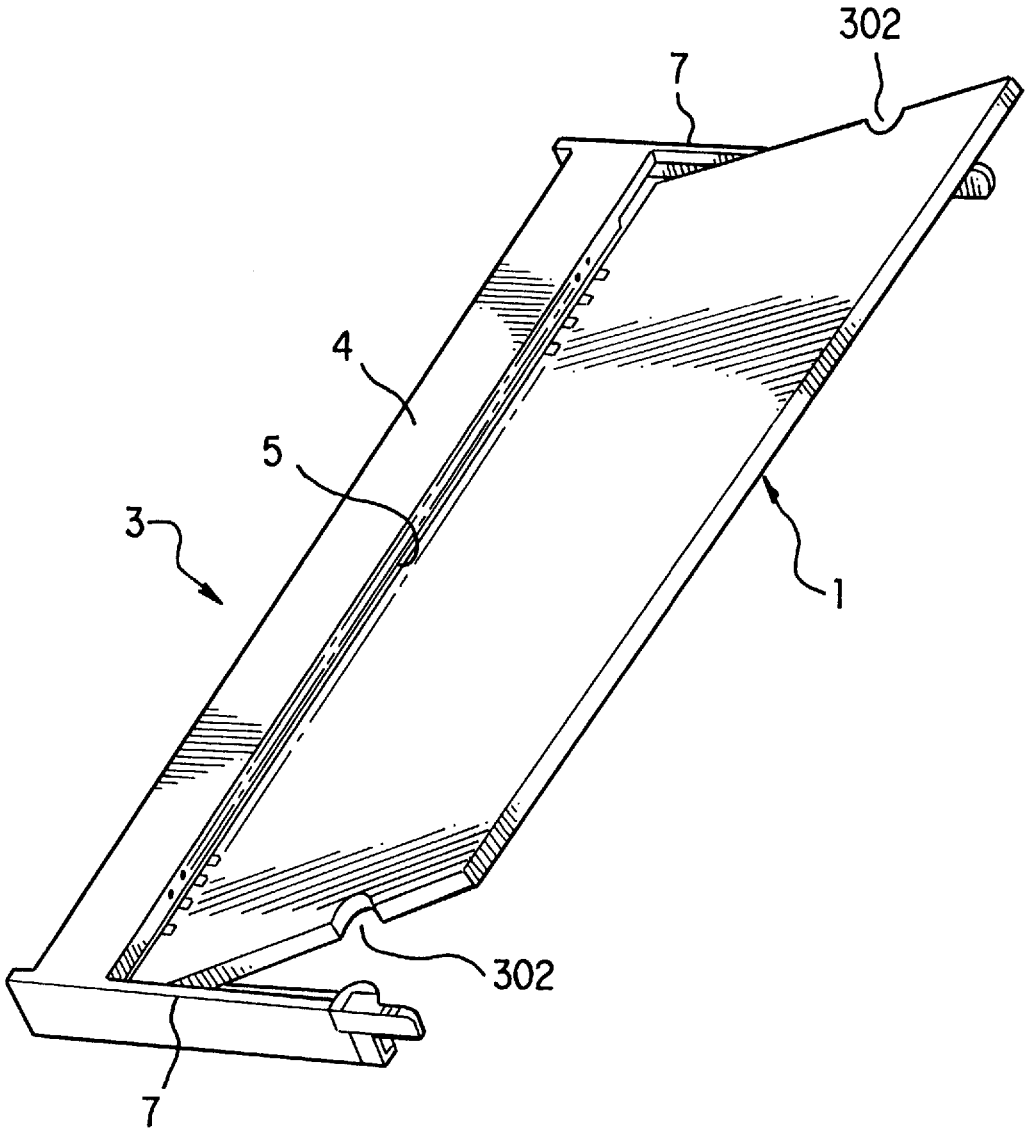
FIG. 1 is a perspective view of an electrical connector according to an embodiment of the invention.
Figure 2:
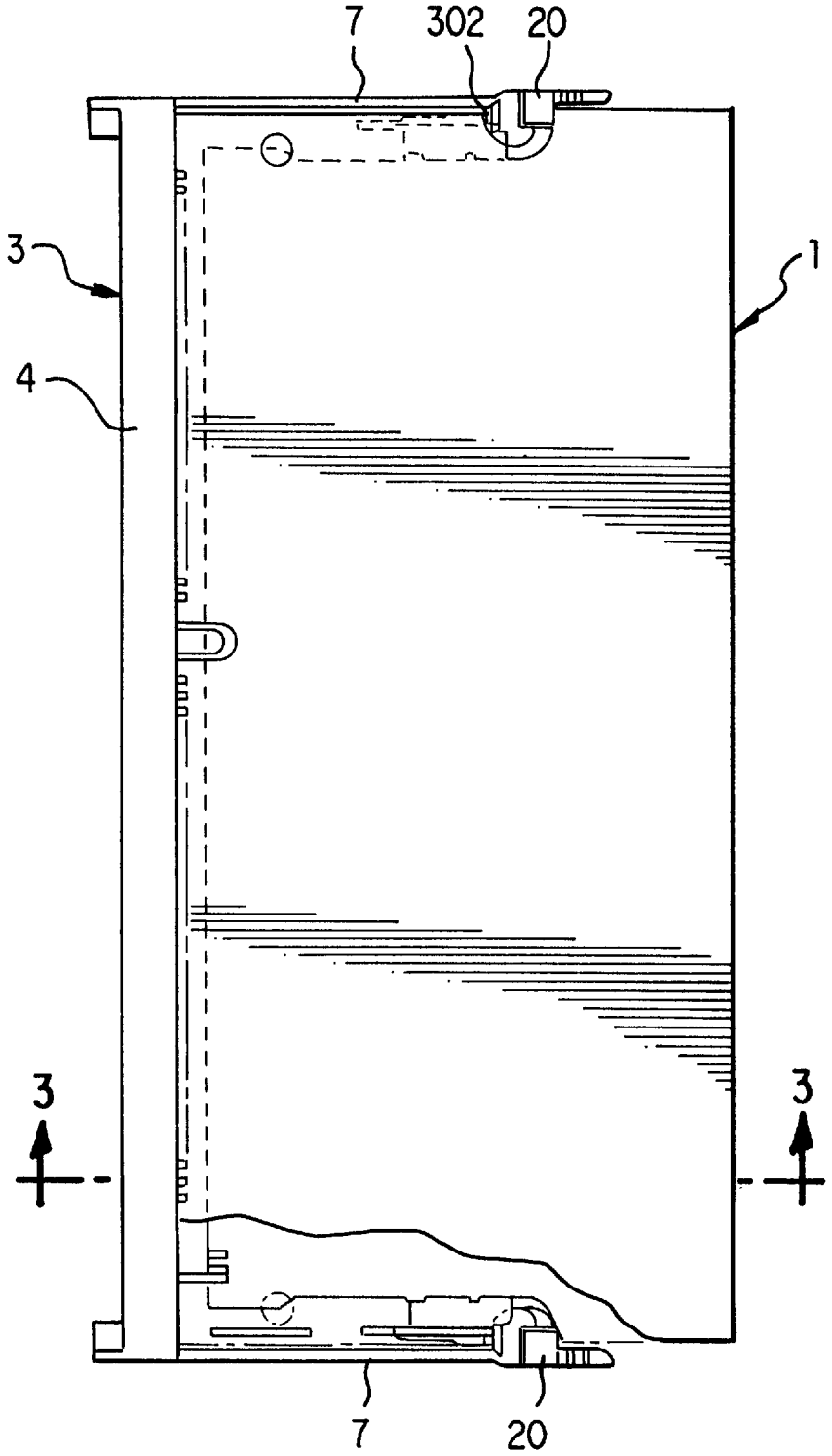
FIG. 2 is a top view of the electrical connector.

In FIGS. 1 and 2, an electrical connector includes a housing 3, a pair of metal fittings or fixing member 9, and contact elements 103 and 105. The metal fittings 9 and the contact elements 103 and 105 are fixed to the housing 3 upon assembling the connector. The assembled housing 3 is soldered to a mother board by the surface mounting technique to increase the mounting density. The housing 3 consists of a base 4 and a pair of lock mechanisms 7 extending laterally from opposite ends of the base 4. The base 4 and the lock mechanisms 7 are molded integrally.

A slot 5 is provided in the base 4 to receive a daughter board. A plurality of arranging apertures are provided in upper and lower tiers in the slot 5 to hold contact elements. The upper and lower apertures are offset from each other and correspond to pads of the daughter board.

Figure 3:
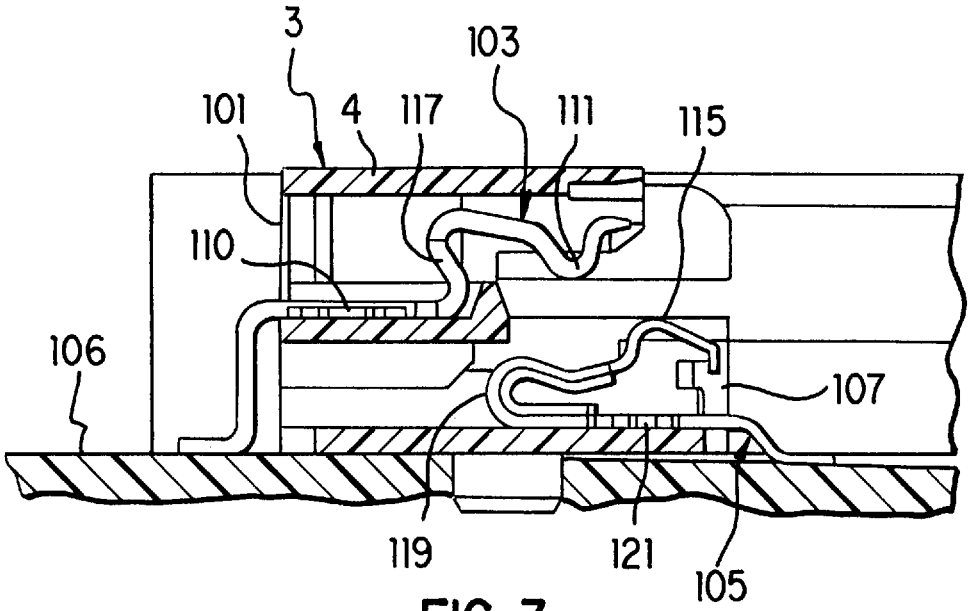
FIG. 3 is a sectional view taken along line 3—3 of FIG. 2.

In FIG. 3, the upper and lower arranging apertures are shown in the same plane for simplicity. There are two types of contact elements. An upper contact element 103 is press fitted into an upper arranging aperture 101 while a lower contact element 105 is press fitted into a lower arranging aperture 107. The upper contact element 103 is inserted into the upper arranging aperture 101 in a direction opposite to the insertion direction of the daughter board while the lower contact element 105 is inserted in the same direction.

A C-shaped contact section 111 or 115 is provided on each contact element. The contact section 111 or 115 has a rolled surface to be electrically connected to each pad of the daughter board thereby connecting the daughter board to the mother board.

The upper and lower contact elements 103 and 105 are placed such that the lower contact section 115 is closer to the insertion port than the upper contact section 111 to minimize the insertion force of the daughter board.

The upper and lower contact elements 103 and 105 are made by stamping and bending. Unlike stamped terminals, the bent terminals have no portion exposed on the mother board, thus providing more circuit pattern areas and freedom of pattern design.

An S-shaped section 117 extends from the C-shaped section 111 of the upper contact element 103 to provide a press-fit section 110. Such a configuration minimizes not only the length but also the rigidity of the contact element. Also, when the daughter board hits against the contact section 111, it prevents the contact element from being damaged.

Figure 4A:
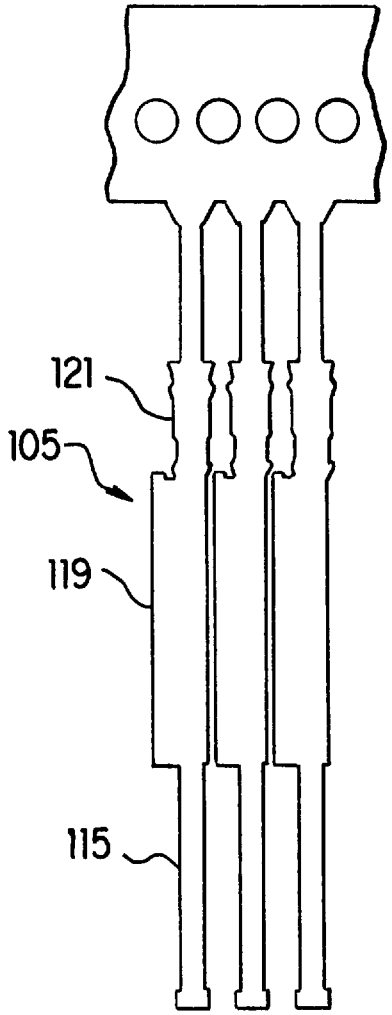
FIGS. 4(*a*) and 4(*b*) are top views of lower contact elements under construction.
Figure 4B:
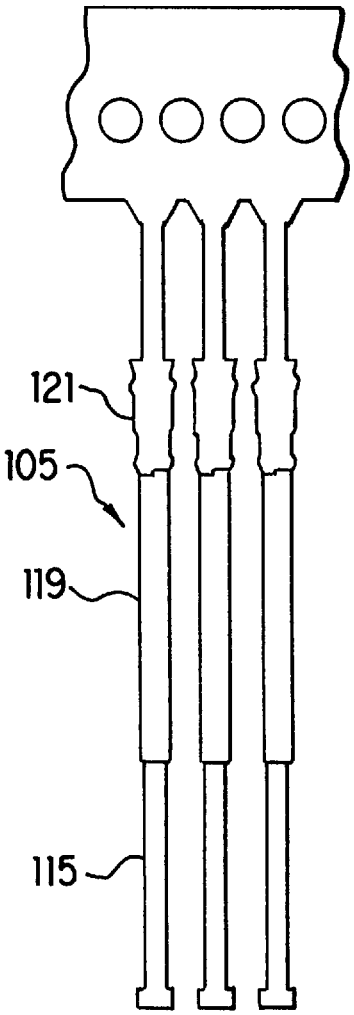

A press-fit section 121 extends from the contact section 115 via a U-shaped section 119 to be soldered to the mother board. In FIGS. 4(*a*) and 4(*b*), in order to reduce the height of the housing, the lower contact element is made by bending a thin sheet of metal. However, the sheet is folded back in the U-shaped section 119, to which the maximum stress is applied, to increase the thickness thereby providing a satisfactory resiliency. Since the press-fit section 121 remains thin, the housing has a small thickness between the press-fit section 121 and the mother board 106.

Figure 5:
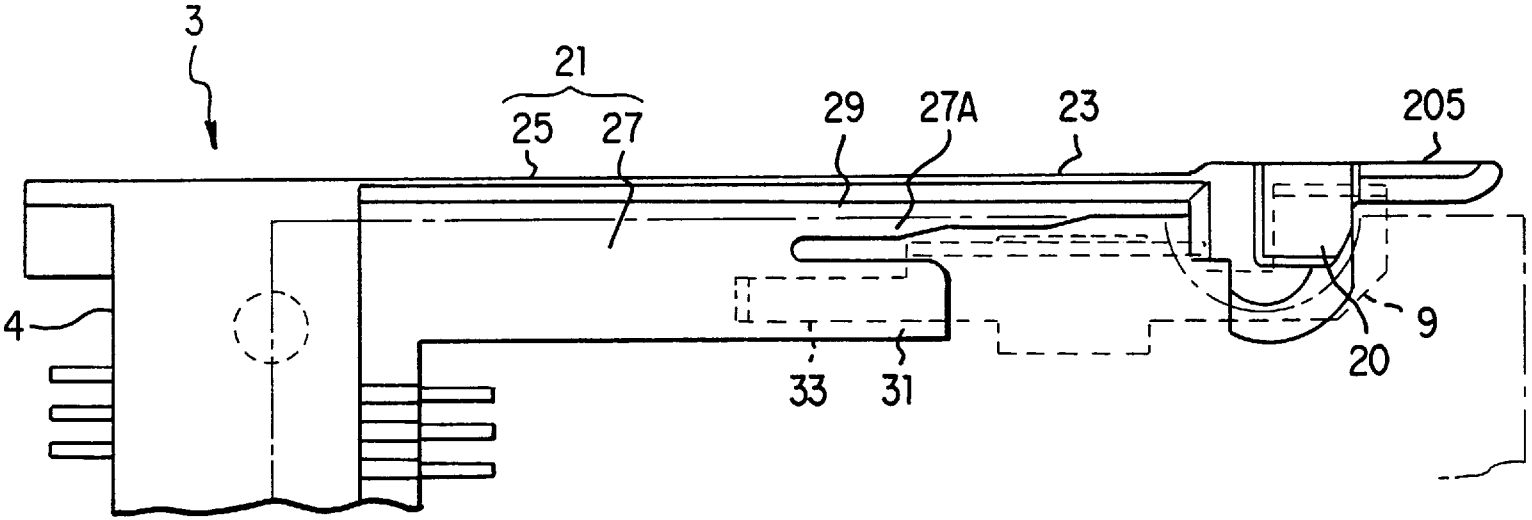
FIG. 5 is a top view of a lock mechanism according to an embodiment of the invention.
Figure 6:
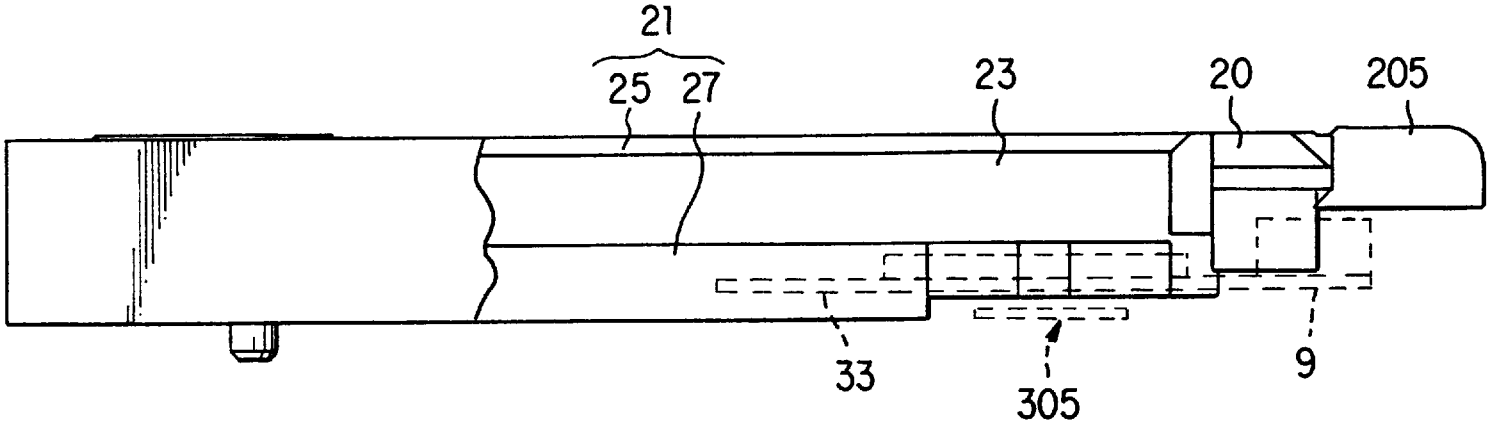
FIG. 6 is a side view of the lock mechanism.

In FIGS. 5 and 6, the lock mechanism consists of a fixed section 21 and a movable section 23 extending from the fixed section. The fixed section 21 is provided to hold the daughter board and protect the movable section while the movable section is provided to secure the daughter board.

The fixed section 21 consists of a vertical portion 25 vertical to the mother board and a flange portion 27 extending inward to a predetermined extent. The movable section 23 consists of substantially only the vertical portion. Consequently, the fixed section 21 is secured to the base 4 by the flange portion 27 while the movable section 23 is flexible inwardly and outwardly.

A protruded portion 31 extends from the flange portion 27 in parallel to the movable section 23. A fixing groove 33 is provided on the protruded portion 31 to receive a fixing member 9 (shown by phantom line).

Figure 7:
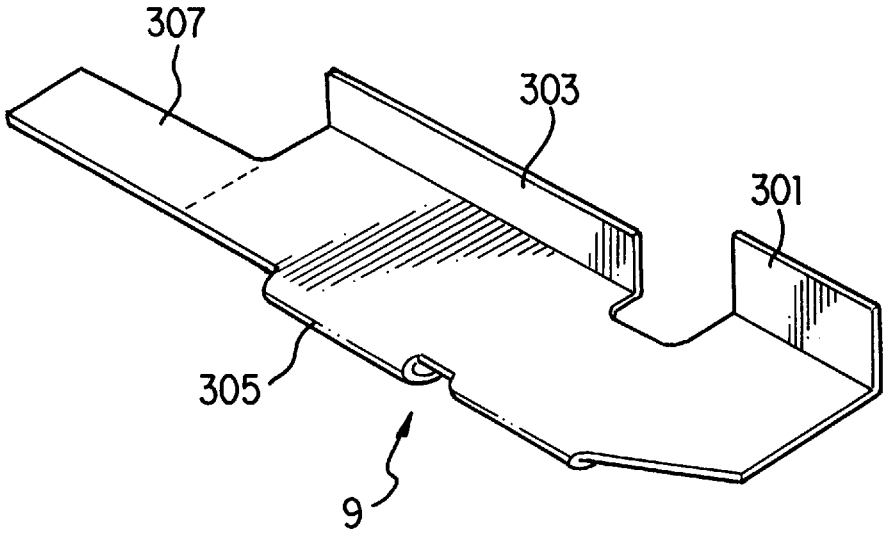
FIG. 7 is a perspective view of a metal fitting according to an embodiment of the invention.
Figure 8:
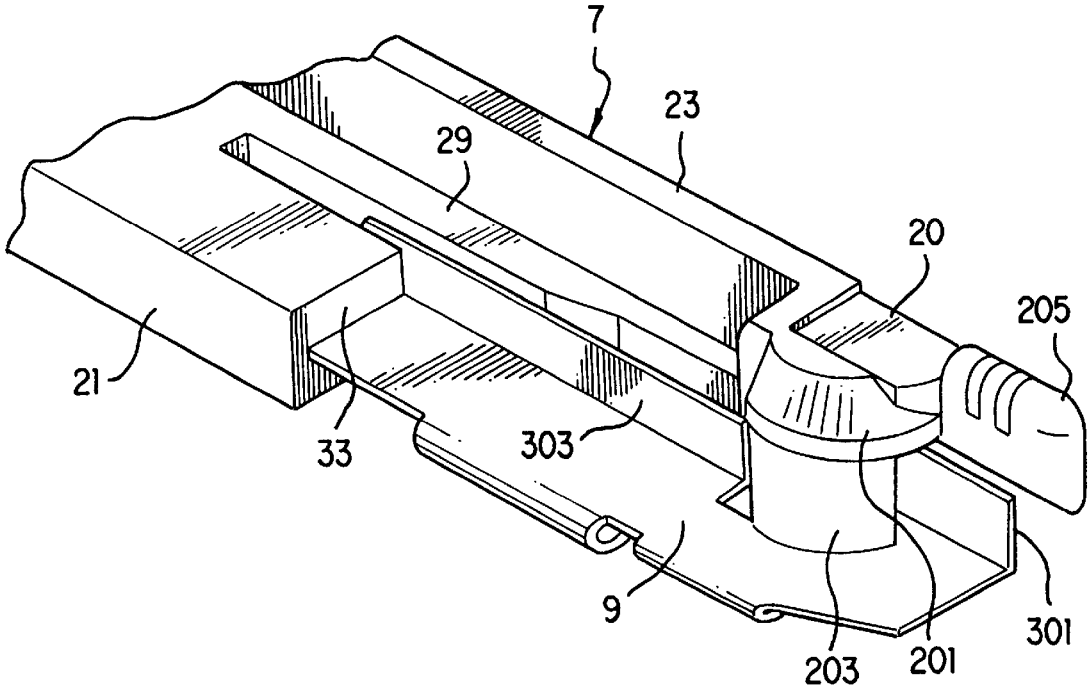
FIG. 8 is a perspective view of the lock mechanism to which the metal fitting is press fitted.

In FIGS. 7 and 8, a press-fit section 307 is provided on the fixing member 9 to be fitted into the fixing groove 33 to extend the fixed section 21. The fixing member 9 is placed inside of and parallel to the movable section 23. Consequently, the area of the mother board covered by the lock mechanism is minimized.

Since the fixed section 21 is extended by the fixing member 9, it is made smaller and stronger than ever before. A soldering portion 305 is provided on the fixing member 9 to solder the housing to the mother board. The fixing member 9 also protects the movable section 23 as described hereinafter.

A hook portion 20 is provided on the movable section 23 to engage a notch 302 (FIG. 1) of the daughter board. The hook portion 20 consists of a semi-circular conic portion 201 and a daughter board engaging portion 203 having a diameter smaller than that of the conic portion 201 to provide a stepped portion.

When the daughter board is inserted into the slot of the housing and rotated toward the housing, the conic portions 201 are moved outwardly by the daughter board or the notches 302. When the daughter board passes the conic portions 201, the hook portions 20 snap the daughter board. That is, the daughter board engaging portions 203 engage the notches 302 to secure the daughter board. The daughter board can be removed by moving the hook portions outwardly with knobs 205.

The root area 29 of the movable section 23 extends inwardly to a predetermined extent under the daughter board to provide a flange 27A. Consequently, the root area 29 has an L-shaped cross-section as the fixed section. The extension length of the root area 29 is smaller than that of the thick portion 27 of the fixed section 21. Thus, the movable section 23 is sufficiently flexible and wide open to receive the daughter board.

The inward and outward movement of the movable section 23 is controlled by two controlling sections of the fixing member 9. A first controlling section 301 extends vertically to the mother board behind the daughter board engaging portion 203. A second controlling section 303 extends vertically to the mother board inside of the movable section 23.

A space sufficiently large to allow the movable section 23 to move is provided between the first controlling section 301 and the daughter board engaging portion 203. The first controlling section 301 is made not project outwardly from the movable section. The abutment between the first controlling section 301 and the daughter board engaging portion 203 is provided at a position where the bottom of the hook portion 20 is opened so that the areas occupied by the first controlling section 301 on the mother and daughter boards are small.

When the movable section 23 moves outwardly, the daughter board engaging portion 203 hits against the first controlling section 301 of the fixing member 9, thereby preventing further outward movement of the movable section 23. When the movable section 23 moves inwardly, the movable section 23 hits against the second controlling section 303, thereby preventing further inward movement of the movable section 23. Thus, the movable section 23 is protected from damage otherwise caused by excessive movement.

Alternatively, the fixing member 9 may be made longer while the fixed section may be made shorter. In place of the hook portion, a projection provided on the knob may engage the controlling section of the fixing member.

Since the fixed section is provided inside of the movable section, the area of the lock mechanism on the daughter board is minimized, making it possible to increase the mounting area of the daughter board. By attaching the fixing member to the fixed section, the small member is able to provide a satisfactory strength so that the area of the lock mechanism on the mother board is minimized. The area of the lock mechanism on the mother and daughter boards is smaller than that where the lock mechanism is molded integrally with the connector body and equal to that where the entire lock mechanism is made of metal.

The L-shaped cross-section of the movable section increases the strength of the movable section to withstand the flexure for receiving the daughter board. The controlling sections of the fixing member prevent excessive inward and outward movement of the movable section to avoid damage to the movable section.

The bent terminals provided in the housing reduce the area occupied by the lower contact elements on the mother board, thus providing a wide area for designing circuit pattern with more designing freedom.

The section of the lower contact element is made thick by folding the sheet so as to provide a satisfactory resiliency. The other part of the contact element remains thin, thus making the low-profile mounting possible.

What is claimed is:

1. An electrical connector for a printed circuit board having a plurality of contact pads. comprising:

a housing with a base having a slot for receiving said printed circuit board;

a plurality of contact elements provided in said slot for contact with said contact pads when said printed circuit board is inserted in said slot;

a pair of fixed sections extending laterally from opposite ends of said base for holding said board in said slot;

a pair of movable sections extending from said fixed sections for latching said board in said slot; and a pair of fixing means attached to said fixed sections substantially inside of said movable sections and having a first controlling section to control outward movement of said movable section and a second controlling section to control inward movement of said movable section.

2. An electrical connector according to claim 1, wherein said movable means comprises a hook member having a reduced bottom portion which engages with said first controlling section when said movable means is flexed outwardly.

3. An electrical connector according to claim 1, wherein said contact element is of a bent type and has a resilient folded-back thick section.

4. An electrical connector according to claim 1, wherein said movable sections have an L-shaped cross-section foot area.

5. An electrical connector according to claim 1, wherein said fixing means is provided with a soldering portion for soldering said housing to a second board.

6. An electrical connector according to claim 1, wherein said fixing means is provided with a press-fit section for attaching said fixing means to said fixed section.

* * * * *